343-700 MS AU 251 EX
8/12/86 OR 4,605,933

United States Patent [19]
Butscher

[11] Patent Number: 4,605,933
[45] Date of Patent: Aug. 12, 1986

[54] EXTENDED BANDWIDTH MICROSTRIP ANTENNA

[75] Inventor: Frank D. Butscher, San Jose, Calif.

[73] Assignee: The United States of America as represented by the Secretary of the Navy, Washington, D.C.

[21] Appl. No.: 618,011

[22] Filed: Jun. 6, 1984

[51] Int. Cl.[4] ..... H01Q 1/38
[52] U.S. Cl. ..... 343/700 MS; 343/830
[58] Field of Search ..... 343/700, 829, 830, 846

[56] References Cited

U.S. PATENT DOCUMENTS

| | | | |
|---|---|---|---|
| 3,823,404 | 7/1974 | Buie | 343/700 MS |
| 4,051,477 | 9/1977 | Murphy et al. | 343/846 |
| 4,063,246 | 12/1977 | Greiser | 343/700 MS |
| 4,074,270 | 2/1978 | Kaloi | 343/700 MS |
| 4,083,046 | 4/1978 | Kaloi | 343/700 MS |
| 4,089,003 | 5/1978 | Conroy | 343/700 MS |
| 4,160,976 | 7/1979 | Conroy | 343/700 MS |
| 4,197,544 | 4/1980 | Kaloi | 343/700 MS |
| 4,460,894 | 7/1984 | Robin et al. | 343/700 MS |

OTHER PUBLICATIONS

Carver et al. "Microstrip Antenna Technology", IEEE Trans., vol. AP-29, No. 1, Jan. 1981, pp. 2-24.
Takeichi et al., "Flush Mounted Antennas for Rockets", Mitsubishi Denki Lab Reports, Japan, vol. 11, No. 1/2, Apr. 1970, pp. 51-62.

*Primary Examiner*—Eli Lieberman
*Assistant Examiner*—Michael C. Wimer
*Attorney, Agent, or Firm*—R. F. Beers; C. D. B. Curry; W. C. Daubenspeck

[57] ABSTRACT

A microstrip antenna having approximately an octave bandwidth comprises a planar radiating element disposed approximately coplanar with and in front of an upper ground plane and spaced above a lower ground plane at a distance equal to approximately one-tenth wavelength at the lowest operating frequency (one-quarter wavelength at the upper operating frequency). A thin dielectric layer is disposed on top of the upper ground plane which is coupled to the lower ground plane. The antenna, which is linearly polarized, is fed from the rear by a launcher that is approximately coplanar with the radiating element and mounted above the dielectric layer. Impedance matching means are provided for improved performance.

10 Claims, 10 Drawing Figures

FIG_6
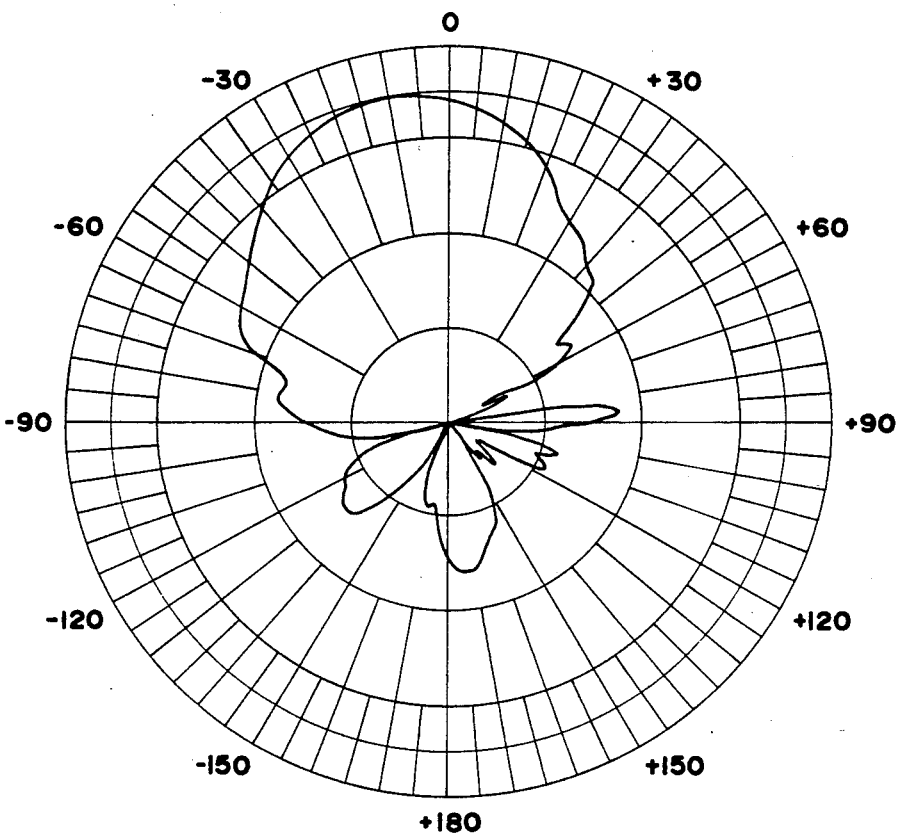
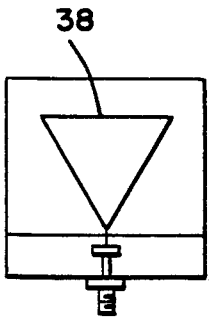
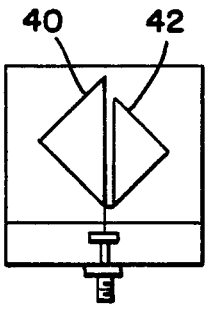
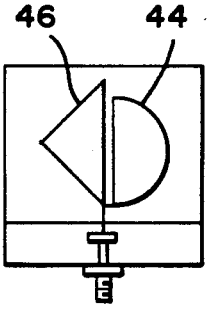
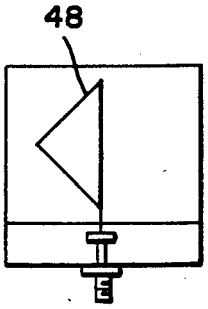
FIG_7 FIG_8 FIG_9 FIG_10

EXTENDED BANDWIDTH MICROSTRIP ANTENNA

FIELD OF THE INVENTION

The present invention relates in general to microstrip antennas and, in particular, to a microstrip antenna having an extended bandwidth.

BACKGROUND OF THE INVENTION

In recent years much work has been done on microstrip antennas. These microstrip antennas provide an antenna having ruggedness, low physical profile, simplicitiy, and low cost and conformal arraying capability. One drawback of microstrip antennas is that they provide a very limited bandwidth; the typical bandwidth is in the range of from two to six percent. The greatest bandwidth offered at present by this class of antennas according to the literature is around twenty percent. It would be a significant advantage, particularly in aircraft applications, to provide an antenna having increased bandwidth and at the same time retaining the advantages of microstrip construction.

SUMMARY OF THE INVENTION

It is therefore the primary object of the present invention to provide a light weight, low profile antenna having an improved bandwidth characteristic.

Another object of the present invention is to provide improved bandwidth in an antenna that can be arrayed for directional or omnidirectional patterns.

Another object of the present invention is to provide an antenna which can accommodate any planar type element for pattern shaping and extended bandwidth.

These and other objects are provided by an antenna structure employing a microstrip radiating element. The radiating element is disposed approximately coplanar with and in front of an upper ground plane. Both the radiating element and the upper ground plane are spaced approximately one-tenth wavelength at the lowest operating frequency to one-quarter wavelength at the highest operating frequency above a lower ground plane which is shorted to the upper ground plane. A thin dielectric layer is disposed on the top surface of the upper ground plane. The antenna is fed from the rear by a launcher that is approximately coplanar with the radiating element and mounted above the dielectric layer on the upper ground plane. The feed line, which is disposed on top of the dielectric layer, is coupled to a feed point on the radiating element selected to produce linear polarization. An impedance satching collar, which is disposed between the radiating element and the lower ground plane, provides support for the radiating element.

The antenna of the present invention operates in the microstrip mode at the lower end of its operating band and in the coupled image mode at the higher end of its operating band with a smooth transition between the two modes. An antenna according to the present invention may typically provide a reasonably efficient radiation pattern across a bandwidth of an octave or greater.

The advantages and features of the present invention will become apparent when the same becomes better understood from the following detailed description when considered in conjunction with the accompanying drawings wherein:

BRIEF DESCRIPTION OF THE DRAWING

FIG. 6 is a polar plot showing the radiation pattern of an antenna as shown in FIG. 1; and FIGS. 7–10 are plan views of alternative embodiments of the present invention employing microstrip radiating elements of different shapes.

DESCRIPTION OF THE PREFERRED EMBODIMENT

Figure 1:
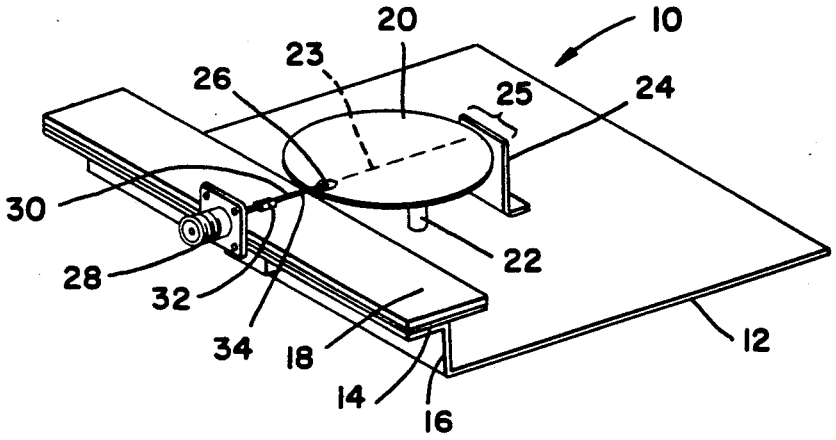
FIG. 1 is a perspective view of a preferred embodiment of an antenna according to the present invention.
Figure 2:
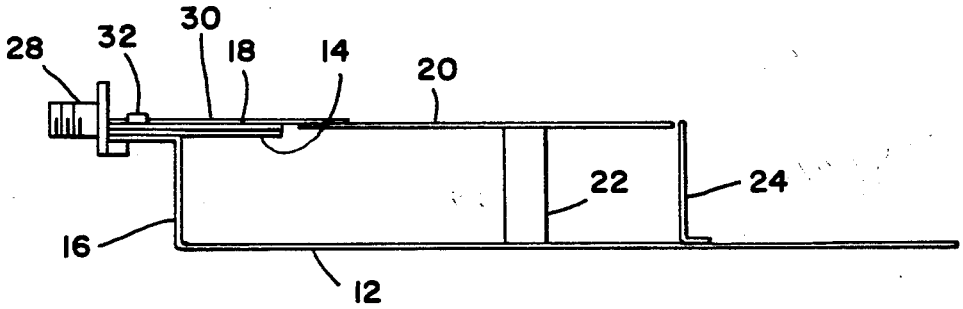
FIG. 2 is a side view of the antenna of FIG. 1.

Referring now to the drawings, FIGS. 1 and 2 show a preferred embodiment for an extended bandwidth microstrip antenna 10. The antenna 10 includes a flat, rectangular electrically conductive ground plane 12 of rigid construction. The ground plane 12 may be of a metal such as aluminum of sufficient thickness to provide strength as shown in FIG. 1 or may be a thin copper microstrip if a dielectric supporting structure is provided. A second ground plane 14 is disposed above and parallel to ground plane 12. In the embodiment of FIG. 1, the aluminum plate which forms the lower ground plane 12 extends upward at the rear 16 of the lower ground plane to support and electrically connect the upper ground plane 14 to the lower ground plane. The upper ground plane 14 is a rectangular conductive element, preferrably separated vertically from the lower ground plane 12 by approximately one-quarter wavelength at the highest operating frequency of the antenna. This implies a separation approximately equal to one-tenth wavelength at the lowest operating frequency for the expected bandwidth of the antenna.

A thin dielectric layer 18 is disposed on the top surface of the upper ground plane 14. A microstrip radiating element, in this case a disk 20, is disposed above the lower ground plane 12 approximately coplanar with the upper ground plane 14. The radiating element 20 is supported by an impedance matching collar 22 which extends vertically between the radiating element and the lower ground plane 12. The collar 22, which is located on the centerline 23 of the disk 20 toward the front end of the radiating element a short distance beyond the midpoint, serves to support the radiating element and also to match the impedance of the input signal.

An impedance matching tab 24 extends upward from the lower ground plane 12 to the region in front of the radiating disk 20 along the centerline 23. The tab 24 primarily provides matching capacitance and must not be too narrow in width 25 or it will cause excessive inductive loading.

The radiating disk 20 is approximately coplanar fed at a feed point 26 located on the centerline 23 so that a linearly polarized wave is launched. A coaxial-to-microstrip launcher 28 is mounted horizontally at the rear of the upper ground plane 14 with the shielding coupled to the ground planes 12 and 14. The feed line 30 is disposed on the surface of the dielectric layer to provide an approximately coplanar feed to disk 20. Both a coplanar feed and a linearly polarized signal are required to provide an extended bandwidth characteristic. It has been found that a conventional vertical feed arrangement destroys the broad band characteristic of the present invention.

An impedance matching strap 32 is coupled across the feedline 30. The section 34 of the feedline 30 between the matching strap 32 and the feed point 26 may be broadened to provide additional impedance matching and also provide additional support for the rear of the disk 20.

Figure 3:
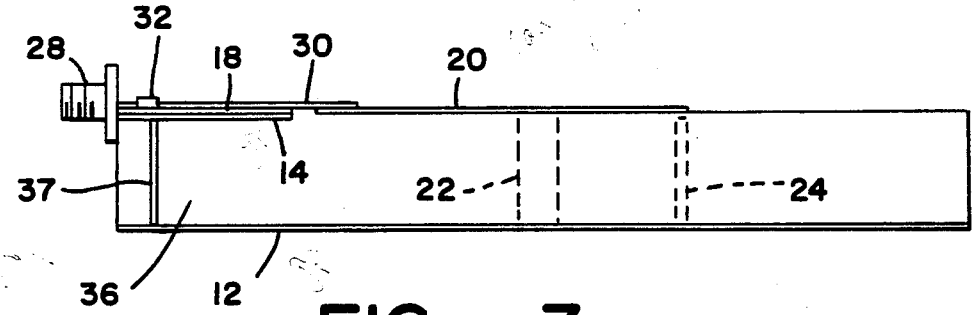
FIG. 3 is a side view of an alternate embodiment of the present invention.

FIG. 3 shows a side view of an alternative embodiment. In this embodiment the coplanar upper ground plane 14 and radiating disk 20 are fabricated on the top surface of a dielectric spacer 36. The lower ground plane 12 is fabricated on the bottom surface of the spacer 36. A conducting strap 37 is provided to short the upper ground plane 14 to the lower ground plane 12. This embodiment does not require the impedance matching collar 22 to support the radiating disk 20; however, the collar and the matching tab 24 are still useful in providing an impedance match for the antenna. If a high dielectric spacer 36 is used, the separation of the radiating element and the lower ground plane may be reduced by approximately $1/\sqrt{\epsilon}$ (where $\epsilon$ is the dielectric constant of the spacer) from the separation required in the embodiment of FIG. 1. Although the physical separation is reduced, the electrical separation is maintained.

Figure 4:
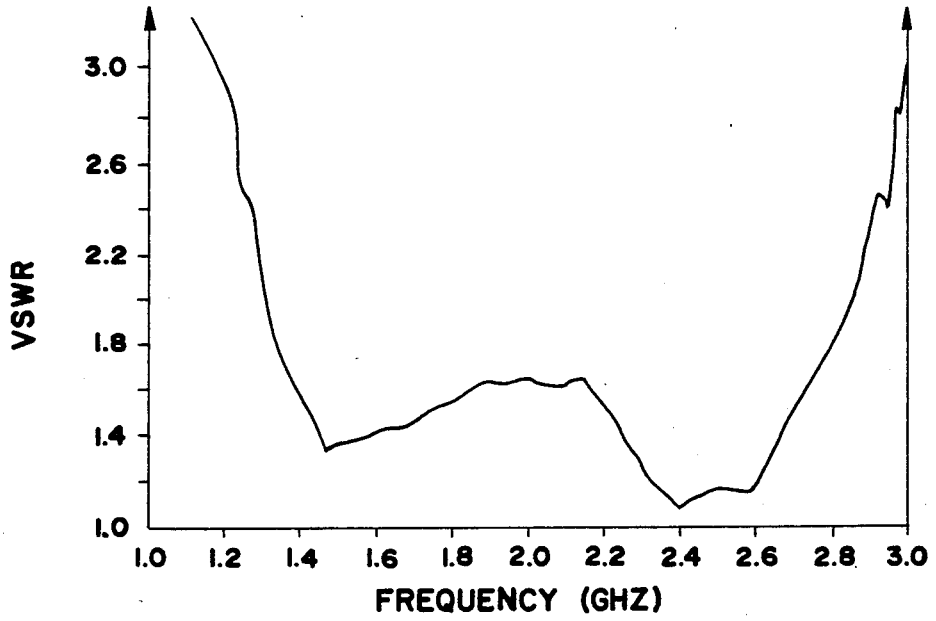
FIG. 4 is a plot of voltage standing-wave ratio versus frequency illustrating the operation of an antenna as shown in FIG. 1.
Figure 5:
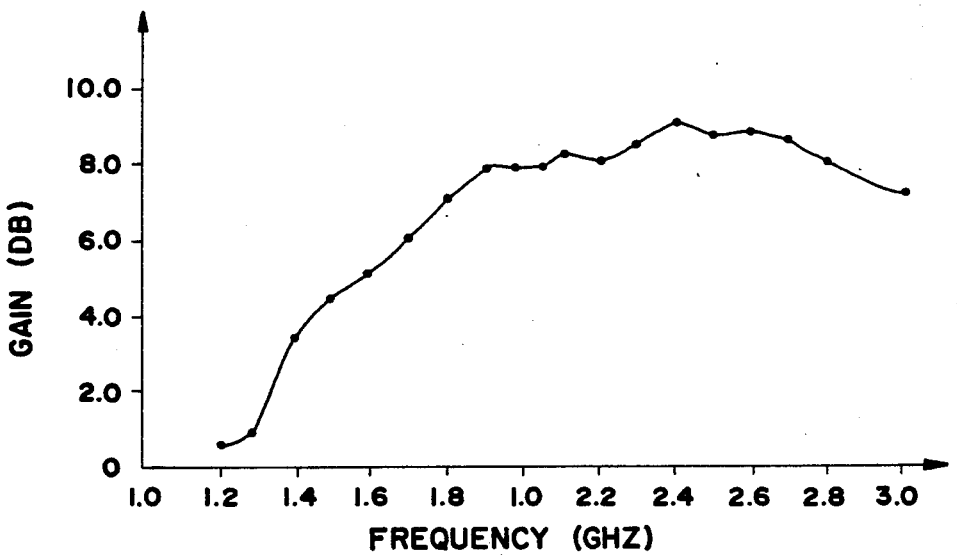
FIG. 5 is a plot of gain versus frequency illustrating the operation of an antenna as shown in FIG. 1.

FIGS. 4, 5, and 6 illustrate the operation of an antenna according to the present invention. The data shown in FIGS. 4, 5, and 6 were obtained for an antenna as shown in FIG. 1 having a disk radiator of two and one-half inches in diameter and a separation of approximately one inch between the upper and lower ground planes. The plot of voltage standing-wave ratio (VSWR) versus frequency of FIG. 4 and the plot of gain versus frequency of FIG. 5 illustrate that the antenna operates satisfactorily from around 1200 MHz to to 3000 MHz. The performance of the antenna fell off sharply beyond 3000 MHz. The bandwidth of over an octave or approximately 85 percent for the embodiment of FIG. 1 compares with the 2–6 percent bandwidth typically found in microstrip antennas. FIG. 6 is a polar plot illustrating the radiation pattern of the antenna of FIG. 1.

In operation, the antenna of FIG. 1 utilizes the microstrip mode at the lower end of its operating band. At the higher end of the band the coupled image mode (antenna parallel to the ground plane) is the predominant mode of operation. There is a smooth transition between the two modes indicating a slight overlap of the modes.

For an antenna of the type shown in FIG. 1 and employing a disk radiator two and one-half inches in diameter (as is the case of the data of FIGS. 4–6), as the separation between the two ground planes increases beyond an inch, the gain of the antenna at the high end starts to drop; however, the gain at the low end remains solid. As the separation decreases below one-half inch, the gain at the low end falls off. The size of the upper ground plane is not critical; however, the parallel feed should be over the upper ground plane as the feed will tend to radiate in that area if the upper ground plane is not present. As noted before, nonlinear polarization or vertical feed from the back of the disk results in a narrow bandwidth.

FIGS. 7–10 illustrate embodiments employing microstrip radiating elements other than a disk. As compared to a disk radiating element, the equilateral triangle 38 of FIG. 7 exhibits the same smooth transition between modes and a broader pattern characteristic. The embodiment of FIG. 8 utilizes right triangles 40 and 42 of different sizes to provide a smooth operating characteristic. Similarly, the half-circle 44/right triangle 46 combination of FIG. 9 exhibits a smooth transition across nearly an octave bandwidth. The corner fed triangle 48 of FIG. 10 exhibits the two modes but without the smooth transition between modes.

Obivously many modifications and variations of the present invention are possible in the light of the above teachings. It is therefore to be understood that within the scope of the appended claims the invention may be practiced otherwise than as specifically described.

What is claimed is:

1. A microstrip antenna having extended bandwidth comprising:

(a) a first conducting ground plane;

(b) a second conducting ground plane disposed parallel to and above said first ground plane, said second ground plane being smaller than said first ground plane and disposed above the rear of said first ground plane; said second ground plane being electrically connected to said first ground plane;

(c) a thin dielectric layer disposed on said second ground plane, (d) a planar radiating element disposed above said first ground plane, said planar radiating element being disposed approximately coplanar with, in front of, and electrically separated from said second ground plane, and;

(e) means for feeding said planar radiating element, said means for feeding being disposed above said second ground plane on said dielectric layer, said means for feeding providing an approximately coplanar feed and a linearly polarized signal to said planar radiating element.

2. A microstrip antenna as recited in claim 1 wherein said planar radiating element is disposed electrically a distance approximately equal to one-quarter wavelength at the lowest operating frequency of said antenna above said first ground plane.

3. A microstrip antenna as recited in claim 1 wherein said planar radiating element is disposed electrically a distance approximately equal to one-tenth wavelength at the highest operating frequency of said antenna above said first ground plane.

4. A microstrip antenna as recited in claim 2 further including (a) an impedance matching collar extending between said first ground plane and said planar radiating element, said collar being normal to the planes of said first ground plane and said planar radiating element.

5. A microstrip antenna as recited in claim 2 wherein said planar radiating element is a disk.

6. A microstrip antenna as recited in claim 5 wherein an impedance matching collar is disposed beyond the midpoint of said disk radiating element toward the front of said disk radiating element.

7. A microstrip antenna as recited in claim 6 including an impedance matching tab extending from said first ground plane to the region in front of said disk radiating element.

8. A microstrip antenna as recited in claim 1 further including a second dielectric layer disposed between said first ground plane and said radiating element.

9. A microstrip antenna as recited in claim 8 wherein said planar radiating element is disposed electrically a distance approximately equal to one-quarter wavelength at the highest operating frequency of said antenna above said first ground plane.

10. A microstrip antenna as recited in claim 8 further including (a) an impedance matching collar extending between said first ground plane and said planar radiating element, said collar being normal to the planes of said first ground plane and said planar radiating element.

* * * * *